US005335640A

United States Patent [19]

Feuling

[11] Patent Number: 5,335,640

[45] Date of Patent: Aug. 9, 1994

[54] ROTOR TO CASING SEALS FOR ROOTS TYPE SUPERCHARGERS

[75] Inventor: James J. Feuling, Ventura, Calif.

[73] Assignee: Feuling Engineering, Inc., Ventura, Calif.

[21] Appl. No.: 901,092

[22] Filed: Jun. 19, 1992

[51] Int. Cl.[5] ..... F01C 19/00

[52] U.S. Cl. ..... 123/559.1; 418/141

[58] Field of Search ..... 123/559.1; 418/141

[56] References Cited

U.S. PATENT DOCUMENTS

| | | | |
|---|---|---|---|
| 2,492,935 | 12/1949 | McCullock et al. | 418/141 |
| 3,174,274 | 3/1965 | Frye | 418/141 |
| 3,977,817 | 8/1976 | Monteil | 418/141 |
| 4,390,331 | 6/1983 | Nachtrieb | 418/141 |

FOREIGN PATENT DOCUMENTS

| | | | |
|---|---|---|---|
| 0176487 | 10/1984 | Japan | 418/141 |
| 0369540 | 7/1963 | Switzerland | 418/141 |

*Primary Examiner*—Richard A. Bertsch
*Assistant Examiner*—Charles G. Freav
*Attorney, Agent, or Firm*—Frank D. Gilliam

[57] ABSTRACT

An improved Roots type supercharger for use with high performance vehicle engines. The supercharger includes rotors within a casing having rotor lobes with raised apex lands that move in a sealing relationship to the casing inside wall and rotor ends that move in a sealing relationship to the inside wall of casing end plates. A plurality of grooves are formed in at least one of the land, rotor end and end plate inside wall to reduce leakage of gases through those seals. The grooves are preferably formed generally perpendicular to the path of gas leakage through the seal.

23 Claims, 2 Drawing Sheets

ROTOR TO CASING SEALS FOR ROOTS TYPE SUPERCHARGERS

BACKGROUND OF THE INVENTION

This invention relates in general to Roots type supercharger and, more specifically, to improvements in reliability and operation of Roots type superchargers through improvements in gas seals between rotors and the adjacent casing and end plates.

Internal combustion engines have long used superchargers of one type or another to get more air into the engine to permit more fuel to be burned and increase engine power output. A variety of superchargers have been developed, including vane type, turbochargers and Roots type superchargers.

Roots type superchargers have come into widespread use with racing automobiles, motorcycles, boats and the like because of their high efficiency and reliability. In its simplest form, a Roots type supercharger consists of two elongated rotors, each shaped like a FIG. 8 in cross section, running between end plates in an oval-shaped casing, on parallel shafts and geared together so that the rotor lobes are always in near-contact along a line. Clearances between the rotors and between rotors and the casing and end plates are kept to a minimum but with no direct contact. As the rotors rotate they collect air from an inlet in the casing carry it around the outside and direct it to an outlet at higher pressure. The inlet side is a considerably lower pressure than the outlet side.

The space between the outer edge of the rotors and the casing surrounding the rotors and between the ends of the rotors and the casing end plates adjacent to the rotor ends must be kept at a minimum to prevent excessive gas leakage therethrough, which would reduce supercharger performance. Contact must be avoided to prevent wear on the rotors or casing or other damage such as scoring which would increase gas leakage. Gases easily pass between excessively spaced surfaces which provide a smooth walled, uniform width, gas passage. Attempts to add surface seal materials, such as Teflon fluorocarbon strips, at these locations have been largely ineffective due to the difficulty of securing the strips in place and rapid wear due to the wiping action of the seals.

Thus, there is a continuing need for improvements in Roots type superchargers to overcome this gas leakage and sealing problem.

SUMMARY OF THE INVENTION

The above-noted problem, and others, are overcome in accordance with this invention by an improvement in a conventional Roots type supercharger which comprises providing a plurality of parallel grooves in at least one of the opposed surfaces at each sealing location. With present superchargers the opposed seal surfaces are smooth, providing a smooth gap of uniform width through which gases can efficiently pass. I have found that where at least one surface is grooved, the resulting highly turbulent flow is much less efficient, significantly reducing flow between the opposed seal surfaces.

Grooves may be provided in raised lands at the apex of each rotor lobe, where the lobe is in a constant sealing relationship with the casing wall. Reducing gas leaking between land and casing wall and between the rotors significantly improves turbocharger efficiency.

In addition to the apex lands, grooved lands, generally in pairs, may be provided on the sides of the lobes to improve sealing between the cooperating lobes on the two rotors to reduce gas leakage between the rotors.

Grooves may also be formed in either or both of the opposed surfaces formed by the casing end plates and the rotor ends. Gases passing from a high pressure to a low pressure region past the rotor ends further significantly reduce the supercharger efficiency. The grooves are formed along lines approximately perpendicular to the anticipated paths of gas leakage; that is, the grooves are formed along lines substantially parallel to a line between the rotor axis. Any suitable number of grooves may be used. For reasonable effectiveness, at least two grooves should be provided.

Typically, the grooves may have depths of from about 0.5 to about 3 mm. and widths of from about 0.5 to about 3 mm. For optimum performance, consistent with strength and economy of machining, grooves having depths of from about 0.5 to 3 mm. and widths of from about 0.5 to 3 mm. are preferred. Preferably, the grooves have sharp edges at the seal surface and have a rectangular configuration to maximize turbulence. For convenience and economy, the grooves are preferably formed by conventional milling operations, although other methods, such as chemical milling may be used, if desired, to form more complex groove patterns.

In the lands at each rotor lobe apex or lobe sides the grooves are generally formed substantially parallel to the axis of the rotor. Excellent results are obtained with from about 2 to 5 grooves in each land.

Grooves may be formed in either or both of the casing end plates or the rotor ends. Grooves may cover the entire sealing surfaces, although generally excellent results are obtained where only selected areas are grooved. While grooves could extend radially from the axis of the rotor, parallel grooves in selected areas are preferred. Optimally, the grooves are parallel to the line between the rotor axis.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
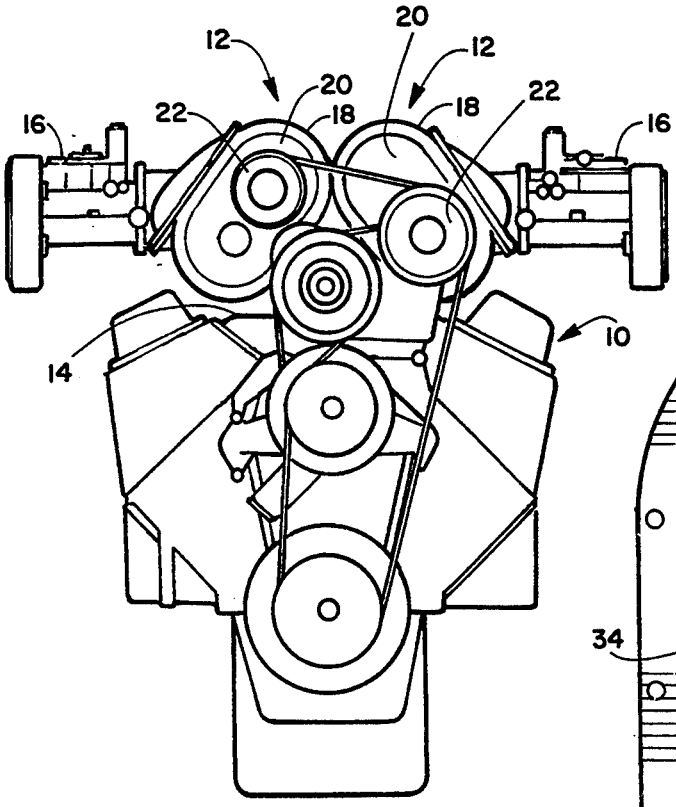
FIG. 1 is a schematic front elevation view of an automobile engine using a pair of Roots type superchargers.

Referring now to FIG. 1 there is seen a schematic front view of an automobile engine 10 having a pair of improved Roots type superchargers 12 mounted on the engine intake manifold 14 and supporting a pair of carburetors 16. Superchargers 12 include an oval-shaped casing 18, end plates 20, and driven rotor shafts driven through pulleys 22 in a conventional manner.

Figure 2:
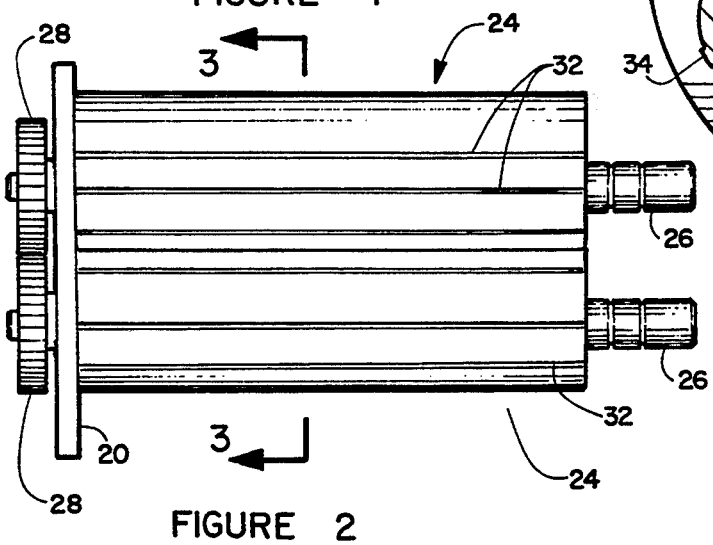
FIG. 2 is a side view of a pair of intermeshed, three-lobe rotors.

A supercharger 12, with casing 18, one end plate 20 and other associated components removed for clarity is shown in side view in FIG. 2. A pair of three-lobed rotors 24 are mounted on rotatable shafts 26. Shafts 26 are mounted in bearings (not shown) in end plates 20. At the left end as seen in FIG. 2, a pair of precisely equal sized gears 28 are mounted on shafts 26 and mesh to assure equal rotation of rotors 24.

Figure 3:
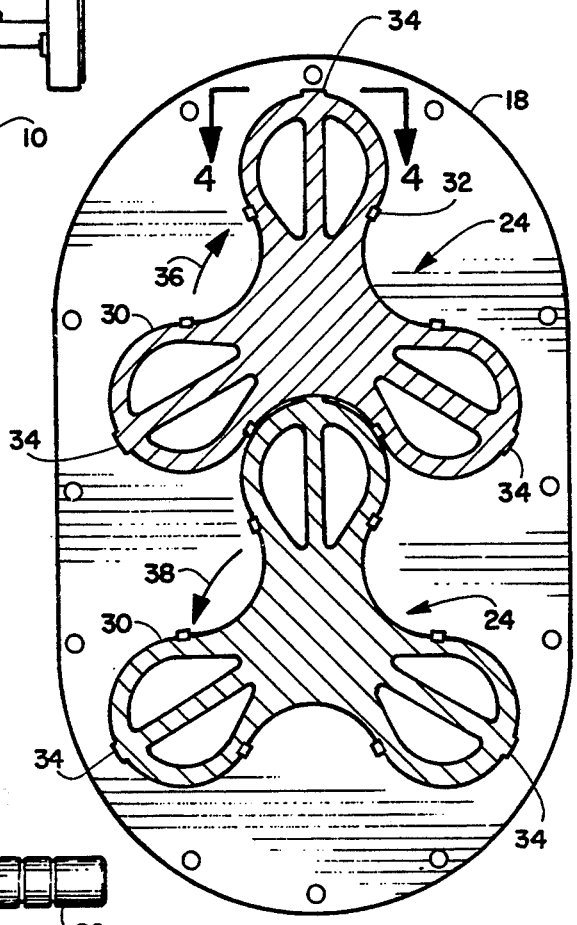
FIG. 3 is a section view of the rotors taken on line 3—3 in FIG. 2.

As seen in section in FIG. 3, each rotor 24 carries three lobes 30 which are precisely shaped and sized to mesh with the inter-lobe space on the opposite rotor, but to not quite contact that opposite rotor. For better sealing against air leakage between lobe and rotor, thin longitudinal strips 32 of a sealing material, such as Teflon fluorocarbon, are typically embedded in lobe grooves. As is conventional, the ends of lobes 30 preferably have a narrow precisely machined land 34 which very closely approaches, but does not contact, the inner wall of casing 18 as the rotors 24 rotate. As rotors 24 rotate in the directions indicated by arrows 36 and 38 and compress gas on the right side as seen in FIG. 3, high pressure gas will leak back between lands 34 and the surrounding casing 18, reducing system efficiency.

Figure 4:
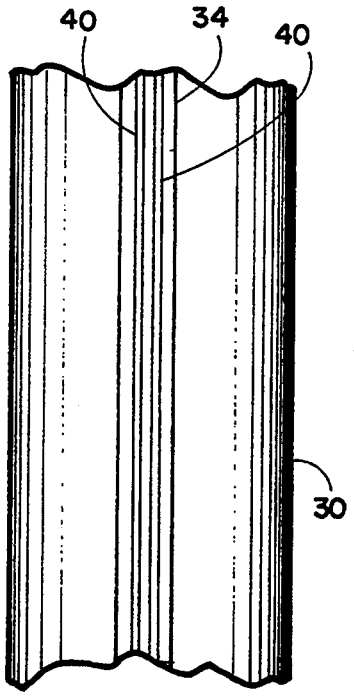
FIG. 4 is a detail view of a portion of a grooved rotor lobe apex land taken at 4—4 in FIG. 3.

In order to reduce this leakage flow between lands 34 and the interior of casing 18, I provide a plurality of narrow grooves 40 running along lands 34 as shown in FIG. 4. While only two grooves are shown in FIG. 4 for clarity of illustration, any suitable number may be used. As mentioned above, while the grooves may have any suitable configuration and spacing, generally grooves having widths of from about 0.5 to 3 mm. and depths of from about 0.5 to 3 mm., spaced about 0.5 to 3 mm. apart are preferred. While the grooves need not be precisely parallel, parallel grooves are preferred for ease of machining and uniformity of performance. For optimum performance it is preferred that grooves 40 run the full length of lands 34, although shorter or broken grooves may be used if desired. While grooves 40 may have any suitable cross section, a straight sided, sharp edged cross section is preferred for optimum results. While the exact reasons for the improved sealing using the grooved seal surfaces is not fully understood, it appears that the grooves cause severely turbulent flow through the seal constriction, disrupting and reducing the flow.

Figure 5:
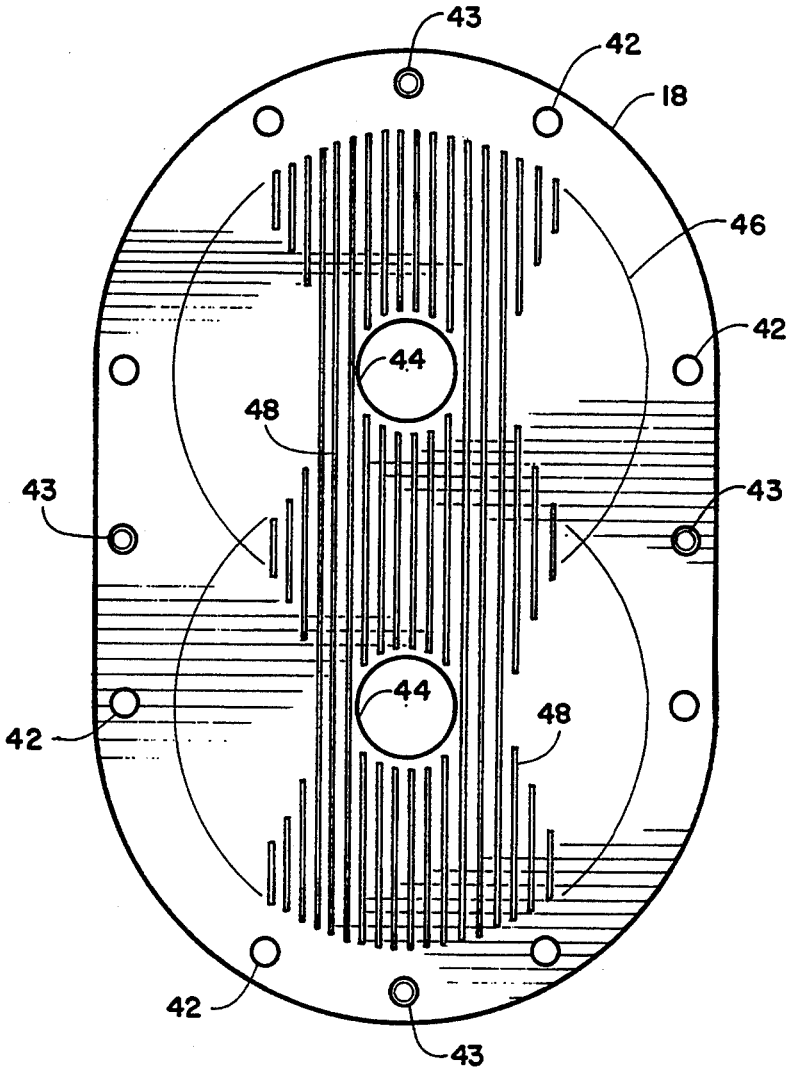
FIG. 5 is an elevation view of the grooved sealing face of an endplate.

The ends of rotors 24 are closely spaced from the interior of end plates 20 to reduce gas flow from the high pressure side of casing 18 to the low pressure side. FIG. 5 shows a preferred groove pattern for the inside surface of end plate 20 to reduce that gas leakage. End plate 20 has a generally oval shape corresponding to the shape of casing 18. Bolt holes 42 are provided for bolts to secure end plate 20 to casing 18. Holes 44 receive shafts 26. Overlapping circular areas 46 are faced so as to conform to the ends of rotors 24 in a closely spaced, uniform, relationship.

Grooves 48 are formed, such as by conventional milling methods, in selected areas on the face of end plate 18 within circular areas 46. While any desired portion of circular areas 46 could be grooved, the most important areas are the vertical central areas as shown, since the transition line between the high pressure and low pressure sides of the casing lies along a vertical central line through shaft holes 44. Grooves 48 may have any suitable size, shape and spacing, as discussed above. For ease of manufacturing, vertical parallel grooves as shown are preferred. However, other patterns, such as grooves formed radially from the center of circles 46, could be used if desired.

Figure 6:
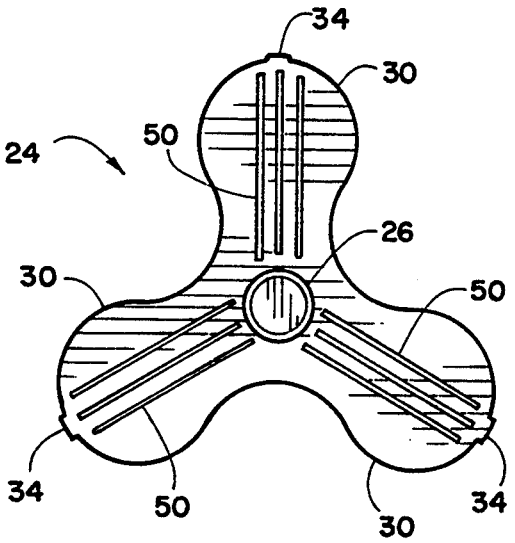
FIG. 6 is a detail elevation view of a grooved rotor lobe end.

In addition to, or in place of, grooves 48 in the inside surface of end plates 18 as seen in FIG. 18, grooves could be formed in the ends of rotors 24 as shown in FIG. 6. A plurality of grooves 50 are formed in each end face of each rotor lobe 30. While only three grooves are shown for clarity of illustration, any suitable number, spacing and groove configuration may be used, as discussed above. For convenience of machining and highest effectiveness, substantially parallel grooves 50 are preferred arranged substantially parallel to the centerline of each lobe 30 of rotor 24. If desired, a radial or other groove pattern could be used. As desired, one or both of the casing interior and the rotor ends may be grooved. The end grooves may be used alone or in conjunction with the grooves in lands 34 as detailed above.

Figure 7:
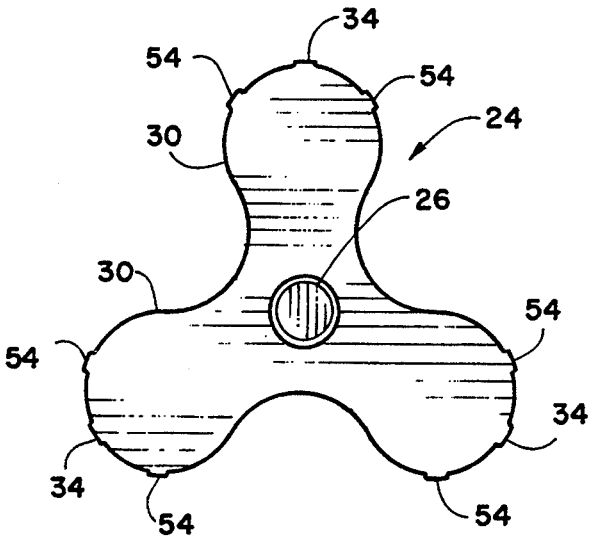
FIG. 7 is a detail elevation view of the end of a rotor lobe having raised lands on the rotor sides.

In another embodiment, as seen in FIG. 7, grooved side lands 54 may be provided on the sides of lobes 30 to seal the space between cooperating lobes in place of the strips shown in FIG. 3. Lands 54 have the same groove patterns as do the apex lands 34.

Other applications, variations and ramifications of this invention will occur to those skilled in the art upon reading this disclosure. Those are intended to be included within the scope of this invention, as defined in the appended claims.

I claim:

1. In a supercharger having a casing with an oval casing and two opposite parallel end plates closing said casing, a pair of parallel cooperating rotors within said casing and mounted on shafts extending through said end plates, each of said rotors having at least two longitudinal parallel lobes adapted to mesh with the lobes on the opposite rotor when said rotors are rotated, and sealing land surfaces between the apex of each lobe and the inside wall of said casing and between ends of said rotors and the inside wall of said casing to reduce gas passage across the sealing surfaces, the improvement comprising:

a plurality of groves having depths of from about 0.5 to 3 mm. and widths of from about 0.5 to about 3 mm. formed in at least one of said apex lands, rotor end surfaces and end plate inside surfaces, said grooves lying approximately perpendicular to the direction of anticipated gas leakage through the seal during at least a part of a rotor rotation cycle, whereby passage of gases across the grooved surface is reduced.

2. The improvement according to claim 1 wherein said grooves are formed in raised lands at each rotor lobe apex, running approximately parallel to the axis of the rotor.

3. The improvement according to claim 1 wherein said grooves are formed in said inside surface of said casing, running substantially parallel to a line drawn between the axes of said rotors.

4. The improvement according to claim 1 wherein said grooves are formed in said rotor lobe ends, said grooves lying substantially parallel to the centerline of each lobe.

5. The improvement according to claim 1 wherein said grooves spaced about 0.5 to 3 mm. apart.

6. The improvement according to claim 5 wherein said grooves have sharp corners at the intersection of groove and the grooved surface.

7. The improvement according to claim 6 wherein said grooves have a substantially rectangular cross section.

8. The improvement according to claim 1 further including grooved side lands on the sides of each of said rotor lobes, said lands running substantially parallel to the rotor axis.

9. In a Roots type supercharger having a casing with an oval casing and two opposite parallel end plates closing said casing, a pair of parallel cooperating rotors within said casing and mounted on shafts extending through said end plates, each of said rotors having at least two longitudinal parallel lobes adapted to mesh with the lobes on the opposite rotor when said rotors are rotated, and sealing surfaces between the apex of each lobe and the inside wall of said casing and between the ends of said rotors and the inside walls of said casing to reduce gas passage across the sealing surfaces, the improvement comprising:

at least three grooves formed in at least one of said apex, rotor end surfaces and end plate inside surfaces, said grooves lying approximately perpendicular to the direction of anticipated gas leakage through the seal, whereby passage of gases across the grooved surface is reduced, said grooves having widths of from about 0.5 to 3 mm., depths of from about 0.5 to 3 mm. and being spaced from about 0.5 to 3 mm. apart.

10. The improvement according to claim 9 wherein said grooves are formed in raised lands at each rotor lobe apex, running approximately parallel to the axis of the rotor.

11. The improvement according to claim 9 wherein said grooves are formed in said inside surface of said casing, running substantially parallel to a line drawn between the axes of said rotors.

12. The improvement according to claim 9 wherein said grooves are formed in said rotor lobe ends, said grooves lying substantially parallel to the centerline of each lobe.

13. The improvement according to claim 9 wherein said grooves have sharp corners at the intersection of groove and the grooved surface.

14. The improvement according to claim 13 wherein said grooves have a substantially rectangular cross section.

15. The improvement according to claim 9 further including grooved side lands on the sides of each of said rotor lobes, said lands running substantially parallel to the rotor axis.

16. A method of reducing gas leakage from high pressure to low pressure regions in a supercharger of the type having an oval casing and two opposite parallel end plates closing said casing and mounted on shafts extending through said end plates, each of said rotors having at least two longitudinal parallel lobes adapted to mesh with the lobes on the opposite rotor when said rotors are rotated, and sealing surfaces between the apex of each lobe and the inside wall of said casing and between the ends of said rotors and the inside walls of said casing to reduce gas passage across the sealing surfaces, which comprises the steps of:

forming a plurality of groves having depths of from about 0.5 to 3 mm. and widths of from about 0.5 to about 3 mm. in at least one of said apex, end surface and casing inside surface, said grooves formed substantially perpendicular to the direction of anticipated gas leakage through the seal, whereby passage of gases across the grooved surface is reduced.

17. The method according to claim 16 wherein said grooves are formed in raised lands at each rotor lobe apex, running approximately parallel to the axis of the rotor.

18. The method according to claim 16 wherein said grooves are formed in said inside surface of said casing, running substantially parallel to a line drawn between the axes of said rotors.

19. The method according to claim 16 wherein said grooves are formed in said rotor lobe ends, said grooves lying substantially parallel to the centerline of each lobe.

20. The method according to claim 16 wherein said grooves spaced about 0.5 to 3 mm. apart.

21. The method according to claim 20 wherein said grooves are formed with sharp corners at the intersection of groove and the grooved surface.

22. The method according to claim 21 wherein said grooves are formed to a substantially rectangular cross section.

23. The method according to claim 16 including the further steps of providing raised side lands on the sides of said lobes running substantially parallel to the axis of said rotor, and forming spaced parallel grooves along the length of said side lands.

* * * * *